US007341435B2

(12) United States Patent
Vicars

(10) Patent No.: US 7,341,435 B2
(45) Date of Patent: Mar. 11, 2008

(54) FLUID END

(75) Inventor: Berton L. Vicars, Odessa, TX (US)

(73) Assignee: Gardner Denver, Inc., Quincy, IL (US)

( * ) Notice: Subject to any disclaimer, the term of this patent is extended or adjusted under 35 U.S.C. 154(b) by 199 days.

(21) Appl. No.: 10/173,837

(22) Filed: Jun. 19, 2002

(65) Prior Publication Data

US 2003/0235508 A1 Dec. 25, 2003

(51) Int. Cl.
*F04B 17/00* (2006.01)
*F04B 35/00* (2006.01)

(52) U.S. Cl. ..... 417/360; 417/454; 417/568; 137/884; 137/512

(58) Field of Classification Search ..... 417/360, 417/454, 568; 137/884, 512
See application file for complete search history.

(56) References Cited

U.S. PATENT DOCUMENTS

| | | | | |
|---|---|---|---|---|
| 144,844 | A | 11/1873 | Gould et al. | |
| 185,578 | A | 12/1876 | Rankin | |
| 1,705,800 | A | 3/1929 | Akeyson | |
| 2,078,347 | A | 4/1937 | Shepherd et al. | |
| 2,854,021 | A | 9/1958 | Baldwin , Jr. et al. | |
| 3,098,642 | A | 7/1963 | Kucmerosky et al. | |
| 3,373,695 | A | 3/1968 | Yohpe | 103/153 |
| 3,427,988 | A | 2/1969 | Redman et al. | 103/153 |
| 3,800,824 | A | 4/1974 | Medina | |
| 3,870,439 | A * | 3/1975 | Stackowiak et al. | 417/454 |
| 3,882,883 | A | 5/1975 | Draegemueller | |
| 4,277,229 | A * | 7/1981 | Pacht | 417/454 |
| 4,368,756 | A | 1/1983 | Carlson | |
| 4,432,386 | A | 2/1984 | Pacht | 137/327 |
| 4,508,133 | A * | 4/1985 | Hamid | 137/68.22 |
| 4,520,837 | A * | 6/1985 | Cole et al. | 137/68.23 |
| 4,614,661 | A | 9/1986 | White et al. | |
| 4,766,927 | A | 8/1988 | Conatser | |
| 4,771,801 | A * | 9/1988 | Crump et al. | 137/68.26 |
| 4,878,815 | A * | 11/1989 | Stachowiak | 417/63 |
| 5,052,435 | A | 10/1991 | Crudup et al. | |

(Continued)

FOREIGN PATENT DOCUMENTS

CA 1113346 12/1981

OTHER PUBLICATIONS

IDS from 10/114,356, now Patent No. 6,695,007, Vicars , Suction Valve.

(Continued)

*Primary Examiner*—William H. Rodriguez
(74) *Attorney, Agent, or Firm*—James B. Conte

(57) ABSTRACT

A fluid end for a high-pressure pump including a unitary body with a plurality of horizontal passages each for receiving a reciprocating plunger at one of its ends and a pressure relief valve at the other of its ends. The body is provided with a corresponding number of vertical passages each of which intersect one of the horizontal passages and contains a suction valve at its bottom and a discharge valve at its top. A suction manifold is hingedly attached to the bottom of body to provide a flow of fluid into the body via the suction valves. A discharge passage intersects the vertical passages and receives fluid pressurized by the plungers via discharge valves and ports such from the fluid end.

14 Claims, 3 Drawing Sheets

U.S. PATENT DOCUMENTS

| | | | | |
|---|---|---|---|---|
| 5,145,340 | A * | 9/1992 | Allard | 417/568 |
| 5,171,136 | A | 12/1992 | Pacht | 417/571 |
| 5,253,987 | A | 10/1993 | Harrison | 417/566 |
| 5,636,975 | A | 6/1997 | Tiffany et al. | 417/454 |
| 5,947,387 | A * | 9/1999 | Zink et al. | 239/227 |
| 6,382,940 | B1 * | 5/2002 | Blume | 417/571 |
| 6,435,475 | B1 | 8/2002 | Blume | |
| 6,544,012 | B1 * | 4/2003 | Blume | 417/559 |
| 6,623,259 | B1 * | 9/2003 | Blume | 417/559 |
| 6,910,871 | B1 * | 6/2005 | Blume | 417/571 |
| 7,172,175 | B2 * | 2/2007 | Vicars | 251/324 |
| 2004/0170507 | A1 * | 9/2004 | Vicars | 417/360 |

OTHER PUBLICATIONS

Notice of References Cited from 10/114,356, Vicars, now Patent No. 6,695,007 for Suction Valve.

Cross-section of a suction valve alleged to be on sale one year prior to filing date.

Jan. 24, 2001-Letter to Cudd Pumping Services (2 pp).

Jan. 24, 2001-Memo to Bert Vicars (2 pp).

Jan. 30, 2001-Memo from Cudd (3 pp).

Feb. 1, 2001-Letter to Cudd (2 pp).

Feb. 15, 2001-Letter to Cudd (2 pp).

Feb. 15, 2001-Letter to Conroe Plastic Mold, Inc. (1 p).

Mar. 7, 2001-Letter to C.B. Gear & Machine, Inc. (4 pp).

May 18, 2001-Letter to Conroe Plastic Mold, Inc. (1 p).

May 31, 2001-Letter to Cudd (2 pp).

Jul. 16, 2001-Letter to Conroe (2 pp).

Jul. 18, 2001 - Letter to Cudd (Jimmy Brown 1 page).

Jul. 18, 2001 - Letter to Cudd (Billy DeShazer, 2 pp).

Feb. 12, 2002 - Letter to Conroe (1 page).

Cross-section of a suction valve which was on sale more then one year prior to the filing date Previously cited by applicant as being alleged to have been on sale.

* cited by examiner

FLUID END

FIELD OF THE INVENTION

The present invention relates generally to pumps having pumping chamber pressure responsive fluid distributors.

BACKGROUND OF THE INVENTION

It is difficult to produce oil and gas in an economic manner from low permeability reservoir rocks. Production rates are often boosted by resorting to hydraulic fracturing, a technique that increases rock permeability by opening channels through which hydrocarbons can flow to recovery wells. During hydraulic fracturing, a fluid is pumped into the earth under high pressure where it enters a reservoir rock and fractures it. Proppants are carried in suspension by the fluid into the fractures. When the pressure is released, the fractures partially close on the proppants, leaving channels for oil and gas to flow.

Specialized pumps are used to develop the pressures necessary to complete a hydraulic fracturing procedure or "frac job." These pumps are usually provided with fluid ends within the body of which reciprocating plungers place fluids under pressure and valves control fluid flow to and from the plungers. The body of a fluid end is an aggregate of metal blocks releasably fastened to provide access to internal components for servicing. Unfortunately, the joints between the blocks and the supporting features for the valves tend to weaken the body of a fluid end, limiting its pressure rating, and making it susceptible to corrosion, leaks and cracks. Thus, it is not unusual for the bodies of fluid ends to fail under load, cutting short their useful lives.

Installing and servicing conventional fluid ends is difficult since their parts often weigh hundreds of pounds. A hoist is often required to lift and position the various portions of a fluid end body and, at this point in time, these portions are not typically provided with attachment features for hooks, chains or cables. Equally difficult is moving a suction manifold into place beneath a fluid end body since its awkward shape and great weight usually requires numerous hands for proper positioning. A need, therefore, exists for a fluid end of great strength and whose principal parts users can easily move.

SUMMARY OF THE INVENTION

In light of the problems associated with conventional oilfield pumping equipment, it is a principal object of the present invention to provide a fluid end of great strength, durability and fatigue resistance. Such a fluid end features a "mono-block" design wherein its body is produced from a single piece of metal. Passages within the body retain reciprocating plungers and valves that pressurize fluids and control their flow through the fluid end. Since the body does not require seals between its constituent parts, it is not particularly susceptible to internal corrosion, fluid leaks and metal fatigue during normal use.

It is another object of the invention to provide a fluid end of the type described with reinforced suction valve seat decks. Such seat decks are made possible by employing compact, stem-guided suction valves within the fluid end rather than conventional, and larger, wing-guided valves. The stem-guided valves fit within shallow pockets in the fluid end requiring less material be removed from the fluid end body than was possible in the past. Providing the seat decks with shallow bevels also adds strength by more evenly distributing loads imparted by the suction valves to the remainder to the fluid end body.

It is an additional object of the invention to provide a fluid end with a body to which a hook, chain, cable, or other like lifting device can be attached so that it can be easily lifted and transported without the use of eyebolts that have a tendency to bend and break. Such a fluid end can, thus, be easily and safely moved about—a great benefit in an oilfield environment where pumps comprising fluid ends rarely remain in place for more than a few months.

It is a further object of the invention to provide a fluid end featuring hinges for the attachment of a suction manifold thereto. Such hinges permit easy access to the interior of the fluid end for while retaining the manifold in a clean and elevated state for easy repositioning and reattachment. With hinge elements of the sort described, servicing of suction valves within a fluid end can be a one-man job.

It is an object of the invention to provide improved elements and arrangements thereof in a fluid end for the purposes described which is relatively inexpensive to manufacture and fully dependable in use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
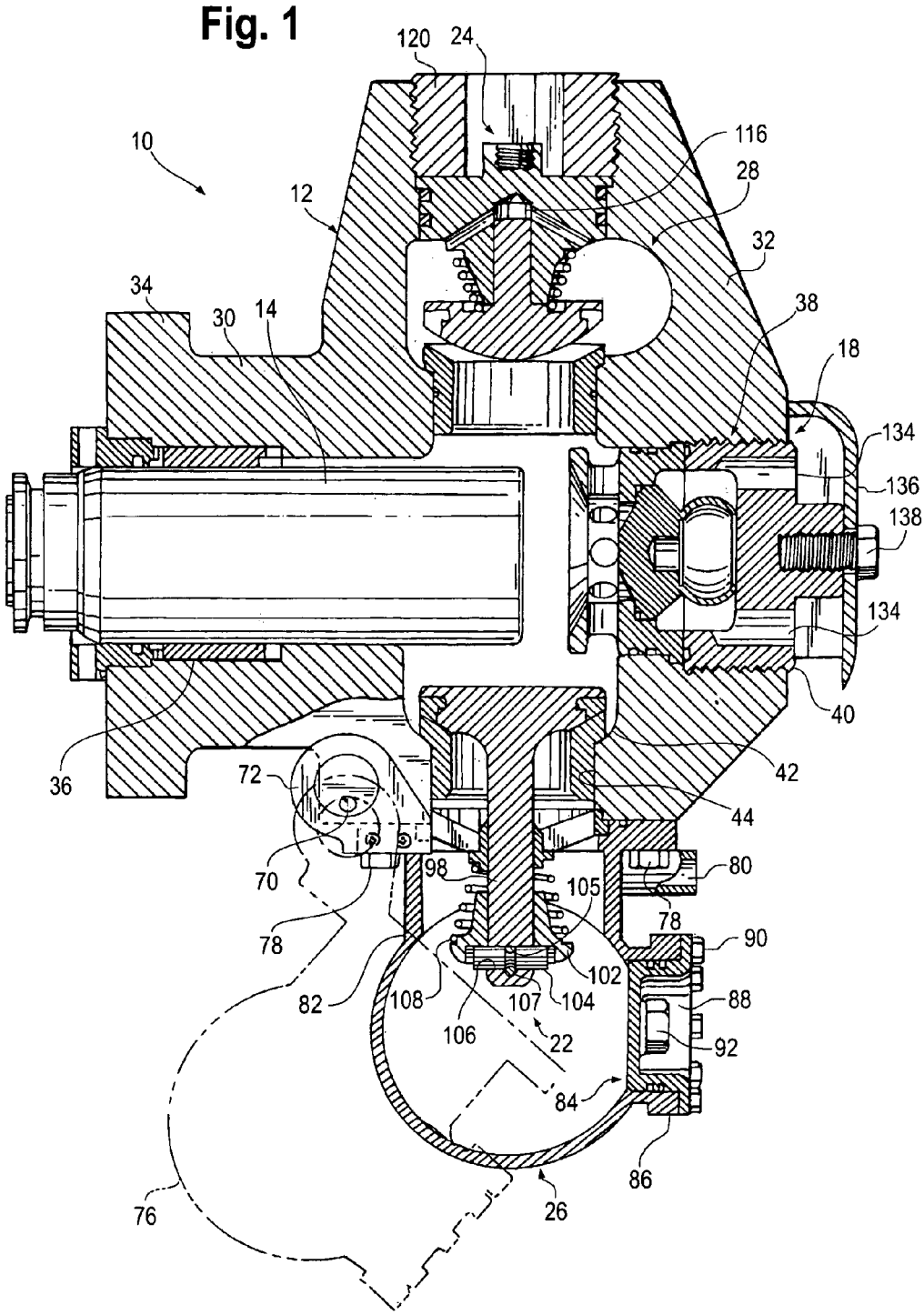
FIG. 1 is a cross-sectional view of a fluid end in accordance with the present invention.
Figure 2:
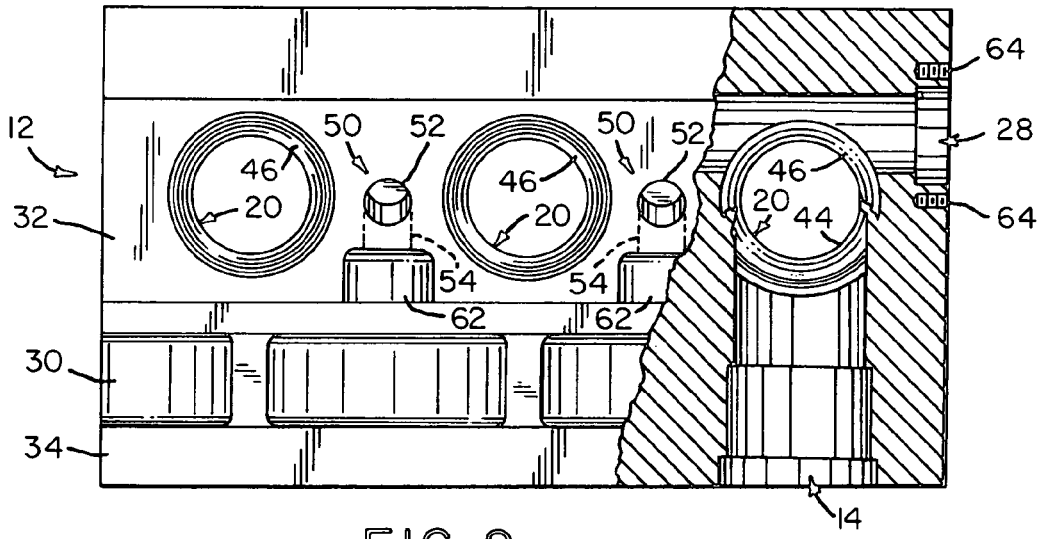
FIG. 2 is a top view of the body forming a principal part of the fluid end of FIG. 1.
Figure 3:
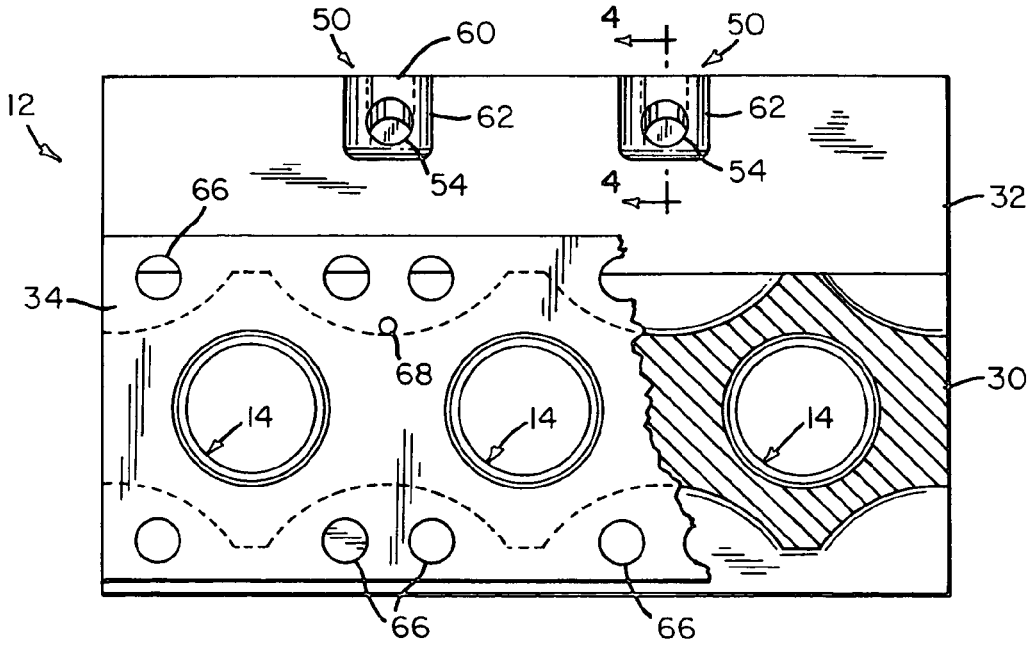
FIG. 3 is a front view of the fluid end body.
Figure 4:
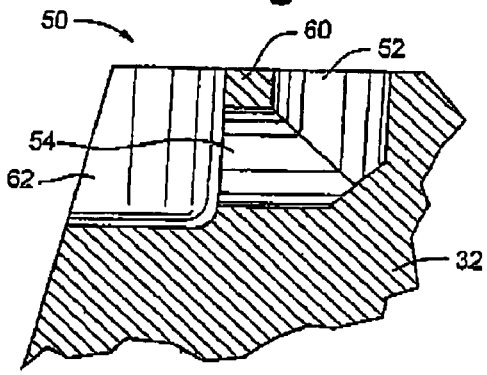
FIG. 4 is a cross-sectional view taken along line 4—4 of FIG. 3.
Figure 5:
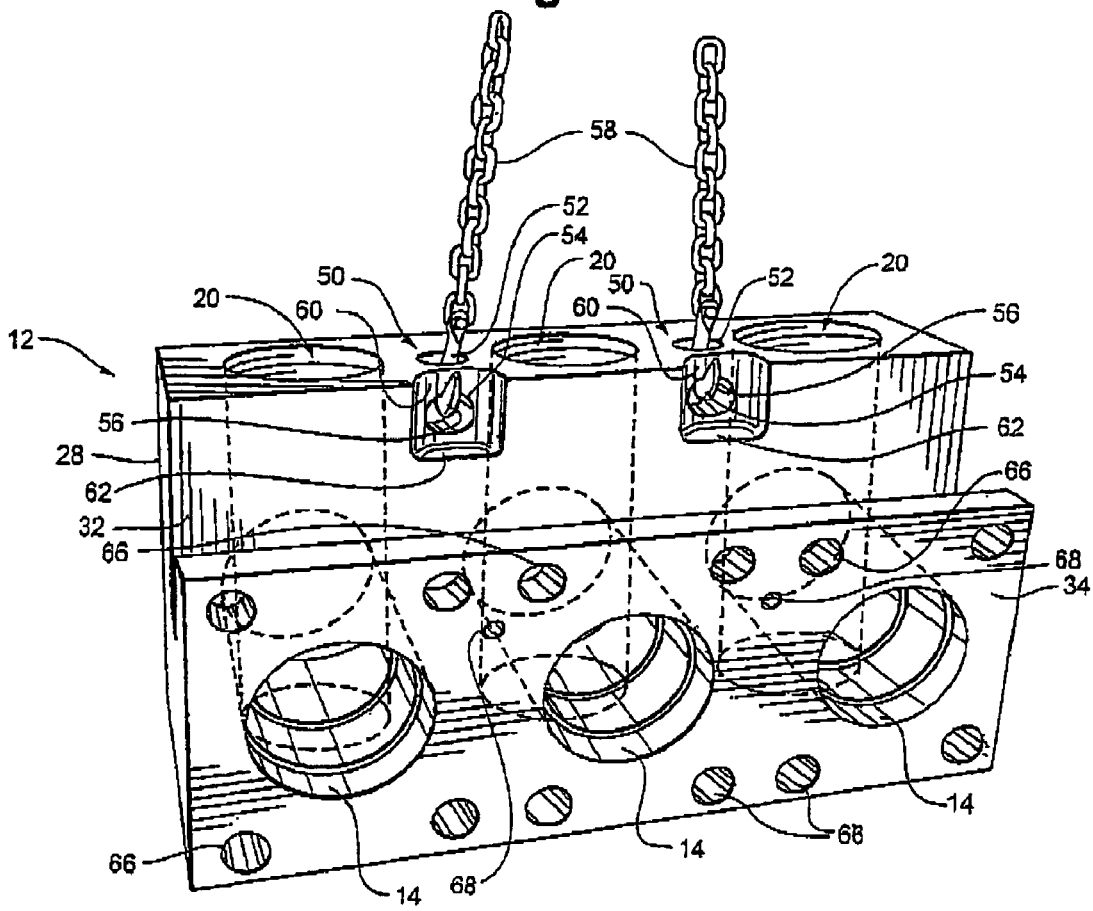
FIG. 5 is a perspective view of the fluid end body shown being lifted by a pair of chains.

Referring now to the FIGS., a fluid end in accordance with the present invention is shown at 10. Fluid end 10 includes a body 12 with a plurality of horizontal passages 14 each for receiving a reciprocating plunger 16 at one of its ends and a pressure relief valve 18 at the other of its ends. Body 12 is provided with a corresponding number of vertical passages 20 each of which intersect one of the horizontal passages 14 and contains a suction valve 22 at its bottom and a discharge valve 24 at its top. A suction manifold 26 is hingedly attached to the bottom of body 12 so as to provide a flow of fluid into body 12 via suction valves 22. A discharge passage 28 intersects vertical passages 20 and receives fluid pressurized by plungers 16 via discharge valves 24 and ports such from fluid end 10.

Body 12 is formed from a high alloy steel forging for maximum strength. Preferably, the forging has a cross-sectional configuration somewhat resembling the letter "H". The crosspiece 30 of body 12 contains horizontal passages 14 whereas the upright member 32 contains vertical passages 20. Upright member 34 serves as a flange for mounting fluid end 10 to the power end of a pump (not shown). It is anticipated that the power end would be conventional in construction with a crankshaft, connecting rods and other parts required to drive plungers 16 back and forth in passages 14.

Horizontal passages 14 pass fully through body 12 from its front to its back. At their front ends, passages 14 are shaped to receive packing elements 36 for providing a fluid-tight seal around plungers 16. At their rear ends, passages 14 are threaded as at 38 to receive the suction nuts 40 of pressure relief valves 18 as will be described further below.

Vertical passages 20 pass fully through upright member 32 from top to bottom. As shown, each of the vertical passages 20 has an area of reduced diameter extending upwardly from the bottom of upright member 32 to a point about half of the way to its associated horizontal passage 14. The top of each of these areas of reduced diameter defines a deck 42 upon which a suction valve seat 44 rests. Similarly, each vertical passage 20 has an area of reduced diameter extending between the bottom of passage 28 and the top of passage 14 that defines a deck 46 upon which a discharge valve seat 48 rests. The bottoms of decks 42 and 46 slope upwardly at an angle of approximately 30°. Such a slope is believed to allow decks 42 and 46 to transfer forces imparted by valve seats 44 and 48 evenly to body 12 thereby reducing the likelihood of fatigue induced cracks forming in body 12.

Body 12 is provided with a pair of lifting eyes 50 so that it can be easily hoisted and transported. Lifting eyes 50 are made by drilling a pair of bores 52 into the top of upright member 32 between the outer and center passages 20 and then drilling a pair of bores 54 into the front of upright member 32 so as to intersect with bores 52. Hooks 56 at the end of chains 58 may be used to grasp the pair of pins 60 formed at the tops of eyes 50 made in this manner. So that the body 12 can be lifted without tipping, pins 60 can be located above the center of gravity of body 12 by milling a pair of deep recesses 62 into the front of upright member 32 that intersect bores 54 and inset pins 60.

Discharge passage 28 extends through upright member 32 from one of its ends to the other. Threaded bores 64 in the ends of body 12 surrounding passages 28 permit conduits (not shown) to be securely connected to body 12 to carry pressurized fluids away from fluid end 10 for use in conducting a frac job or otherwise.

The top and bottom portions of upright member 34 are provided with principal openings as at 66 that permit the passage of threaded fasteners for joining fluid end 10 to the power end of a pump. Secondary openings 68 in the top portion of upright member 34 and beneath principal openings 66 permit any liquids that may fall atop body 12 to drain therefrom.

A pivot pin 70 is secured to each of the opposed, bottom ends of upright member 32 closely adjacent the front thereof. Each pin 70 is an Allen Head Bolt that is threadably fastened to body 12 or is an equivalent. Retaining rings 72, secured to the opposed ends of the manifold mounting plate 74, are suspended from pins 70 at the broken line position 76 shown in FIG. 1 when the manifold mounting bolts 78 are removed. A lever arm-receiving socket 80 is secured to manifold mounting plate 74 to permit suction manifold 26 to be raised and lowered in a controlled fashion.

Extending downwardly from manifold mounting plate 74 are three, fluid inlet ports 82 that receive and partially surround suction valves 22. Suction manifold 26 is suspended from ports 82 and placed by them in fluid communication with suction valves 22. The opposed ends of manifold 26 are open and connected to a fluid source when fluid end 10 is operated. Access openings 84 are provided in manifold 26 adjacent each of the suction valves 22 so that suction valves 22 can be easily examined and serviced. Each of the openings 84 is provided with a peripheral flange 86 for receiving and supporting a close-fitting plug 88. Threaded fasteners 90 about each plug 88 releasably secure such to manifold 26. A hexagonal fitting 92 at the center of each plug 88 permits each plug 88 to be rotated and rapidly removed from its opening 84.

Each suction valve 22 has a valve seat 44 and a piston 94 movably joined to valve seat 44. Piston 94 has a head 96 for engaging the top valve seat 44 and a stem 98 extending downwardly from head 96 through valve seat 44. A valve guide 100 is positioned adjacent the bottom of valve seat 44 and slidably receives stem 98. A valve keeper 102 is fitted upon stem 98 such that valve guide 100 is disposed between valve seat 44 and keeper 102. A keeper pin 104 is slidably positioned within a transverse aperture 106 in stem 98 and abuts the bottom of keeper 102. A compressed spring 108 is positioned between, and exerts opposing forces upon, valve guide 100 and keeper 102 so as to normally retain head 96 in engagement with the top of valve seat 44. The keeper pin has a peripheral groove 107 around the keeper pin at about its midway point. The stem 98 has adjacent the end opposite the head 96, a roll aperature below the keeper pin transverse aperture 106. the roll pin aperture is substantially at a right angle to the keeper pin aperture 106 and intersects the bottom thereof. A roll pin 105 is in the roll pin aperture to and passes through the peripheral groove 107 to lock the keeper pin in place. Generally the keeper pin is larger than the roll pin 105.

Each discharge valve 24 includes a valve seat 48 and a piston 110 for engaging valve seat 48. Piston 110 has a stem 112 that extends upwardly from a head 114 away from valve seat 48 and into a socket 116 in a valve guide 118 retained in a passage 20 by a threaded discharge nut 120. A number of apertures 122 traverse guide 118 and intersect socket 116 to providing pressure relief to socket 116. A compressed spring 124 is disposed between valve guide 118 and head 114 for normally retaining head 114 in engagement with valve seat 48. When a plunger 16 pressurizes fluid, it will flow through seat 48, past head 114, and into discharge passage 28.

Each pressure relief valve 18 includes a suction cover 126 for positioning in passage 14. Suction cover 126 has a passage 128 releasably blocked by a piston 130. Integrally formed with, and extending from, piston 130 is a hollow, bulbous stem 132. Stem 132 abuts suction nut 40 threaded into the outer end of passage 14 to hold suction cover 126 and piston 130 in place. Should a predetermined pressure threshold be reached within passage 14, stem 132 will buckle and deform so as to allow piston 130 to unseat from suction cover 126. The suction nut 40 has passages 134 that transmit pressurized fluid from passage 128, around the unseated piston 130, and to the atmosphere. A deflector shield 136 is joined by a threaded fastener 138 to suction nut 40 to direct the released fluid to a safe location.

With the foregoing discussion, it is believed that one of ordinary skill in the art would have no trouble making and using fluid end 10. For one of less than ordinary skill, it is noted that fluid end 10 produces useful work by moving fluid from suction manifold 26, through valves 22 and 24, and from passage 28 by the reciprocating action of plunger 16. A blockage of any of valves 24 or passage 28 will cause one or more relief valves 18 to open and prevent further damage to fluid end 10. Of course, access to valves 22 for servicing can be easily accomplished by swinging suction manifold 26 downwardly on pivot pins 70. When fluid end 10, or the pump to which it is attached, is no longer required in the field, such may be easily grasped by means of lifting eyes 50 and transported to a suitable storage site.

While the invention has been described with a high degree of particularity, it will be appreciated by those skilled in the art that modifications may be made thereto. For example, the number and location of passages 14, 20 and 28 as well as the features associated therewith can be varied. Therefore, it is to be understood that the present invention is not limited to the sole embodiment described above having a triplex configuration, but encompasses any and all embodiments within the scope of the following claims.

I claim:

1. A body for a fluid end, comprising:

a metal forging having:

a horizontal passage for receiving a reciprocating plunger at one end thereof;

a vertical passage intersecting said horizontal passage and having a suction valve seat deck at its bottom and a discharge valve seat deck at its top;

a discharge passage intersecting the top of said vertical passage;

a pair of pivot pins affixed to the bottom of said metal forging for attaching a suction manifold to the bottom of said metal forging.

2. A fluid end, comprising:

a body having a horizontal passage, a vertical passage intersecting said horizontal passage, and a discharge passage intersecting the top of said vertical passage;

a reciprocating plunger located in one end of said horizontal passage and a pressure relief valve at the other end thereof;

a suction valve located at the bottom of said vertical passage;

a discharge valve located at the top of said vertical passage;

a suction manifold pivotally secured to the bottom of said body and being in fluid communication with said vertical passage; and a pair of pivot pins affixed to said body and a pair of rings loosely encircling said pivot pins and affixed to said suction manifold.

3. The fluid end according to claim 2 wherein said body has a pair of lifting eyes formed in the top thereof.

4. The fluid end of claim 2 wherein the body is a pump fluid end body;

said body having a plurality of horizontal passages and a plurality of vertical passages;

each of said vertical passages intersecting a corresponding horizontal passage.

5. The pump fluid end of claim 4 wherein said body has suction valve seat decks for supporting suction valve seats of said suction valve and discharge valve seat decks for supporting discharge valve seats of said discharge valve, the bottom of said suction valve seat decks and the bottom of said discharge valve seat decks slope upwardly at an angle of about 30 °; and a pair of pivot pins affixed to the bottom of said body for attaching a suction manifold to the bottom of said body.

6. The pump fluid end of claim 5 wherein said suction valve seat is a tube with open, top and bottom surfaces;

a piston having a head engaging the top surface of said suction valve seat and a piston stem extending downwardly from said head through said valve seat, said stem having a keeper pin transverse aperture adjacent an end opposite said head; and said valve has an engaged position wherein in said engaged position a keeper pin is positioned within said transverse aperture to hold a valve keeper from sliding off the valve stem.

7. The pump fluid end of claim 6 wherein said valve stem has adjacent to said end a lock pin aperture below and at a right angle to said keeper pin aperture, said lock pin aperture intersects a bottom portion of the keeper pin aperture to permit a lock pin to lock a peripheral grooved keeper pin in place.

8. A piston and a valve seat for said suction valve of claim 2 comprising:

an opening formed by said valve seat, said opening opens through a top and a bottom surface of said valve seat;

a piston having a head for engaging said top surface of said valve seat and a stem for extending downwardly from said head through said valve seat opening, said stem having a first transverse aperture aperture extending through the stem, and said stem having a second transverse aperture.

9. A high pressure pump piston for mating with the valve seat described in claim 8, wherein said pump piston comprises:

a stem having an end opposite a head;

a keeper pin transverse aperture passing through said stem, and a lock pin aperture adjacent said end, said lock pin aperture intersects a portion of the keeper pin aperture and opens into said keeper pin aperture, said lock pin aperture being positioned relative to said keeper pin aperture so when a keeper pin is in place in the keeper pin aperture, and a lock pin is in place in the lock pin aperture, the lock pin and keeper pin interface with one another.

10. A fluid end, comprising:

a body having a horizontal passage, a vertical passage intersecting said horizontal passage, and a discharge passage intersecting the top of said vertical passage;

a reciprocating plunger located in one end of said horizontal passage and a pressure relief valve at the other end thereof;

a suction valve located at the bottom of said vertical passage;

a discharge valve located at the top of said vertical passage;

a suction manifold pivotally secured to the bottom of said body and being in fluid communication with said vertical passage; and a lever arm-receiving socket secured to said manifold for manipulating said manifold.

11. The fluid end according to claim 10 wherein said body has a suction valve seat deck for supporting a suction valve seat of said suction valve and a discharge valve seat deck for supporting a discharge valve seat of said discharge valve, the bottom of said suction valve seat deck and the bottom of said discharge valve seat deck slope upwardly at an angle of about 30 °.

12. A pump fluid end body for a fluid end, comprising:

a metal forgoing having:

a plurality of horizontal passages and a plurality of vertical passages;

each of said vertical passages intersecting a corresponding horizontal passage and having a seat deck at its bottom and a discharge valve seat deck at its top;

a plurality of discharge passages with each intersecting a top of a corresponding vertical passage;

a pair of pivot pins affixed to the bottom of said body for attaching a suction manifold to the bottom of said body.

13. The pump fluid end body of claim 12 wherein said body has a pair of lifting eyes formed in the top thereof.

14. The pump fluid end body of claim 13 wherein each of said vertical passages has a suction valve seat deck for supporting a suction valve seat of said suction valve and each of said horizontal passages has a discharge valve seat deck for supporting a discharge valve seat of said discharge valve, and the bottom of said suction valve seat decks and the bottom of said discharge valve seat deck slope upwardly at an angle of about 30 °.

* * * * *